US007673656B2

(12) United States Patent
Heiman

(10) Patent No.: US 7,673,656 B2
(45) Date of Patent: Mar. 9, 2010

(54) WOVEN TERRY FABRIC WITH NON-MOISTURE-TRANSPORTING SYNTHETIC FILAMENT YARNS

(75) Inventor: Gary L. Heiman, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 512 days.

(21) Appl. No.: 10/686,104

(22) Filed: Oct. 15, 2003

(65) Prior Publication Data

US 2005/0081939 A1 Apr. 21, 2005

(51) Int. Cl.
*D03D 27/00* (2006.01)
*D03D 27/08* (2006.01)
*D03D 25/00* (2006.01)

(52) U.S. Cl. ..... 139/391; 139/396; 139/392; 139/402; 139/420 R

(58) Field of Classification Search ..... 139/391, 139/396, 392, 402, 420 R, 426 R, 420 A
See application file for complete search history.

(56) References Cited

U.S. PATENT DOCUMENTS

| | | | | |
|---|---|---|---|---|
| 0,384,046 | A | 6/1888 | Leake | |
| 0,776,275 | A | 11/1904 | Valentine et al | |
| 1,139,705 | A | 5/1915 | Murch | |
| 2,089,182 | A | 8/1937 | Branegan | |
| 2,203,450 | A | 6/1940 | Wright | |
| 2,417,320 | A | 3/1947 | Nutter | |
| 2,921,360 | A | 1/1960 | Foster et al | |
| 2,932,327 | A | 4/1960 | Frauwirth | |
| 3,030,691 | A * | 4/1962 | Law | 428/89 |
| 3,302,665 | A * | 2/1967 | Mchargue | 139/25 |
| 3,332,453 | A | 7/1967 | Bloch et al | |
| 3,441,063 | A | 4/1969 | Press et al | |
| 3,446,658 | A | 5/1969 | Rose | |
| 3,484,332 | A | 12/1969 | Fuhr | |
| 3,550,226 | A | 12/1970 | Pachmann | |
| 3,604,474 | A | 9/1971 | Kamei | |
| 3,642,561 | A | 2/1972 | Grobner | |
| 3,721,272 | A * | 3/1973 | Hager | 139/396 |
| 3,721,273 | A * | 3/1973 | Sherrill et al. | 139/396 |
| 3,721,274 | A | 3/1973 | Sherrill et al. | |
| 4,114,549 | A | 9/1978 | Chambley et al. | |
| 4,191,221 | A | 3/1980 | Boyer | |

(Continued)

FOREIGN PATENT DOCUMENTS

| | | |
|---|---|---|
| CH | 595483 | 3/1978 |

(Continued)

OTHER PUBLICATIONS

European Patent Office, European Office Action in counterpart European Application No. 04256029.2-2314, issued Mar. 4, 2008, 5 pages.

*Primary Examiner*—Bobby H Muromoto, Jr.
(74) *Attorney, Agent, or Firm*—Wood, Herron & Evans, LLP

(57) ABSTRACT

A woven terry fabric (10) includes a non-moisture-transporting synthetic filament yarn (F) in at least one of the fill or the warp. The pile loops (T) comprise natural fibers. The fill yarn, warp yarn, and pile loop yarn are woven together in a three-pick terry-weave pattern.

29 Claims, 3 Drawing Sheets

U.S. PATENT DOCUMENTS

| | | | | | |
|---|---|---|---|---|---|
| 4,496,619 | A | | 1/1985 | Okamoto | |
| 4,578,306 | A | | 3/1986 | Heiman | |
| 4,670,326 | A | | 6/1987 | Heiman | |
| 4,714,096 | A | | 12/1987 | Guay | |
| 4,724,183 | A | | 2/1988 | Heiman | |
| 4,726,400 | A | * | 2/1988 | Heiman | 139/396 |
| 4,825,499 | A | | 5/1989 | Baptiste | |
| 4,920,000 | A | | 4/1990 | Green | |
| 4,984,606 | A | * | 1/1991 | Moore et al. | 139/25 |
| 5,084,322 | A | | 1/1992 | Brioschi et al. | |
| 5,167,264 | A | | 12/1992 | Kalin | |
| 5,251,676 | A | | 10/1993 | Yeh | |
| 5,330,817 | A | | 7/1994 | Arnott et al. | |
| 5,336,543 | A | | 8/1994 | Pyle | |
| 5,349,991 | A | | 9/1994 | Okawa et al. | |
| 5,486,500 | A | | 1/1996 | Kaufman | |
| 5,487,936 | A | | 1/1996 | Collier | |
| 5,495,874 | A | | 3/1996 | Heiman | |
| 5,556,696 | A | | 9/1996 | Pinkus | |
| 5,654,067 | A | | 8/1997 | Dinger et al. | |
| 5,667,865 | A | * | 9/1997 | Jackson et al. | 428/92 |
| 5,759,662 | A | * | 6/1998 | Heiman | 428/85 |
| 5,897,933 | A | * | 4/1999 | Prainito | 428/85 |
| 5,932,494 | A | | 8/1999 | Crippa | |
| 6,062,272 | A | * | 5/2000 | Waite | 139/420 A |
| 6,537,640 | B1 | | 3/2003 | Nakamura et al. | |
| 6,546,965 | B2 | * | 4/2003 | Hamby et al. | 139/396 |
| 2003/0190853 | A1 | | 10/2003 | Livingood | |

FOREIGN PATENT DOCUMENTS

| | | |
|---|---|---|
| GB | 893766 | 4/1962 |
| GB | 1030147 | 5/1966 |
| JP | 04 100949 | 4/1992 |
| JP | 07 070875 | 3/1995 |
| JP | 9-302553 | 11/1997 |
| JP | 2000 256940 | 9/2000 |

* cited by examiner

WOVEN TERRY FABRIC WITH NON-MOISTURE-TRANSPORTING SYNTHETIC FILAMENT YARNS

BACKGROUND OF THE INVENTION

1. Field of the Invention

The present invention relates to woven terry fabrics.

2. Description of Related Art

Woven terry fabrics are generally constructed from all natural yarns, such as 100% cotton, warp yarns, fill yarns and pile loop yarns, woven together in generally known fashion. All-natural, 100% cotton, yarns are desirable because the resultant fabric is highly absorbent and comfortable. However, 100% cotton fabrics tend to lack long-term durability. For example, they shrink when exposed to high temperatures such as those of a conventional hot dryer, particularly when wet, as is usually the case. They also deteriorate at an undesirably fast rate, due to yarn damage from normal washing and use.

U.S. Pat. No. 6,062,272 proposes that the terry fabric can be quick-drying by the inclusion of moisture-transporting polyester filaments in the warp or the weft (i.e., fill). Polyester is generally known to be hydrophobic, and thus not moisture-transporting. Indeed, in the '272 patent, the polyester filaments are treated to impart moisture-transporting characteristics thereto so that moisture will transport laterally across the terry fabric, rather than possibly concentrate in some areas.

The treatment methods to impart moisture-transporting characteristics to the inherently hydrophobic polyester fibers adds cost to the terry fabric. Furthermore, the materials used may be disadvantageous, either in the processing of the fibers, or to the users of the terry fabric made therewith. Additionally, others have proposed to add synthetic spun yarn to the warp or fill. While it has generally been recognized that addition of synthetic spun yarns to the terry fabric yarns may reduce shrinkage, it also is believed that the use of such yarns may adversely affect comfort, durability, and overall absorbency of the terry fabric.

SUMMARY OF THE INVENTION

I have determined that addition of non-moisture-transporting synthetic filament yarns in the warp and/or fill, either along with the natural yarns or exclusively, is sufficient to provide a woven terry fabric of desired absorbency and comfort, yet with better durability than is provided with all natural yarns alone or in combination with spun synthetic yarns. Furthermore, I avoid the expense and other possible disadvantages of the treatment process and materials used to overcome the otherwise hydrophobic nature of the synthetic yarn. Advantageously, polyester yarn is used, but without any treatment to overcome its inherent hydrophobic properties.

By virtue of the foregoing, there is thus provided a woven terry fabric having advantages over prior woven terry fabrics. These and other advantages of the present invention shall be made apparent from the accompanying drawings and description thereof.

BRIEF DESCRIPTION OF THE DRAWINGS

The accompanying drawings, which are incorporated in, and constitute a part of this specification, illustrate embodiments of the invention and, together with a general description of the invention given above, and the detailed description of the embodiments given below, serve to explain the principles of the invention.

DETAILED DESCRIPTION OF THE DRAWINGS

Figure 1:
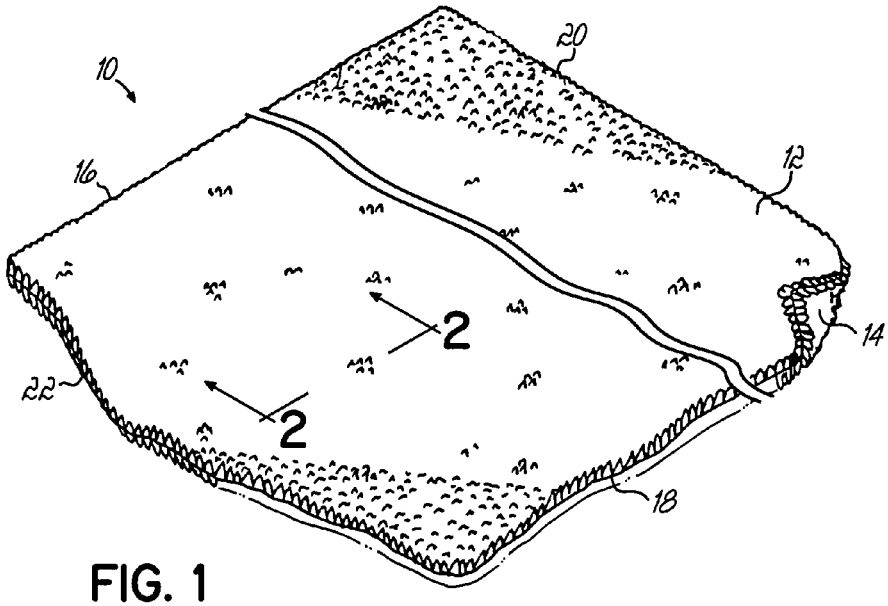
FIG. 1 is a perspective view of a woven terry fabric in accordance with the principles of the invention.
Figure 2:
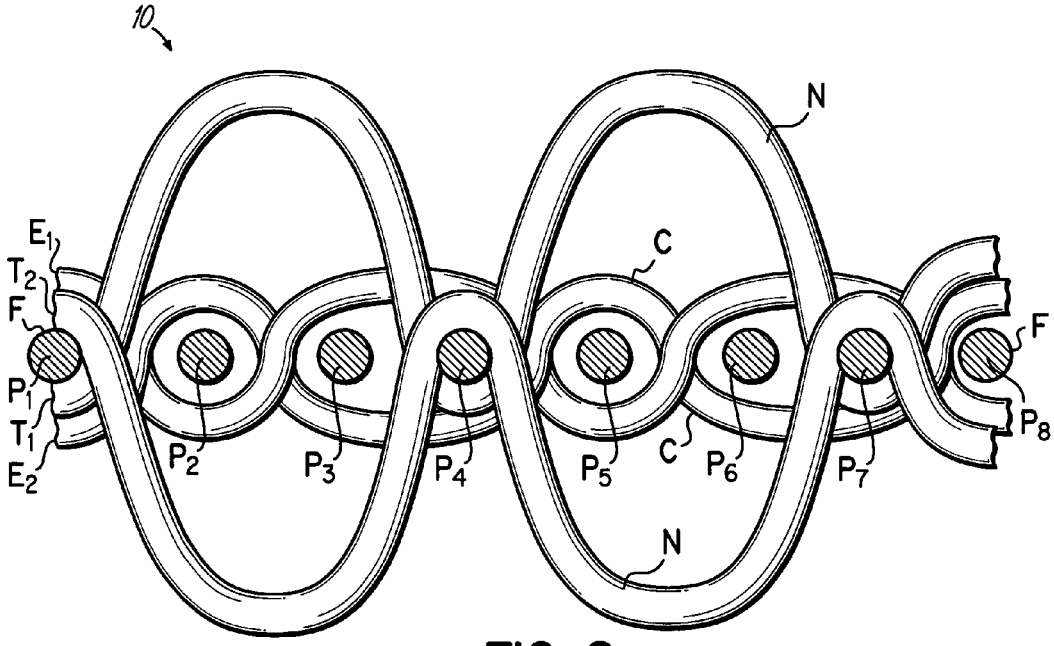
FIG. 2 is a partial, cross-sectional view, not to scale, taken along line 2-2 of FIG. 1.

With reference to FIGS. 1 and 2, a terry fabric 10 is woven in a three-pick terry weave, and includes a top surface 12 and a bottom surface 14, with the surfaces 12, 14 extending between a left selvage 16 and a right selvage 18, as well as a top or trailing end 20 and a bottom or leading end 22. As shown in FIG. 2, the warp ends $E_1$, $E_2$ are formed of spun yarn C, the terry pile loops $T_1$, $T_2$ are formed of all-natural yarn N, and the fill picks $P_1$, $P_2$, $P_3$, $P_4$, $P_5$, $P_6$, $P_7$, $P_8$ are formed of non-moisture-transporting synthetic filament yarn F. One such yarn material may be polyester, although it will be appreciated by those skilled in the art that other, inherently hydrophobic synthetic materials may be used. As seen in FIG. 2, the warp spun yarn C, terry pile loop yarn N, and fill non-moisture-transporting synthetic filament yarn F are woven together in a three-pick terry weave. Although FIG. 2 illustrates part of a single warpwise row, the warp ends and terry pile loops of the other rows of the fabric 10 may be constructed and arranged as shown in FIG. 2.

Figure 3:
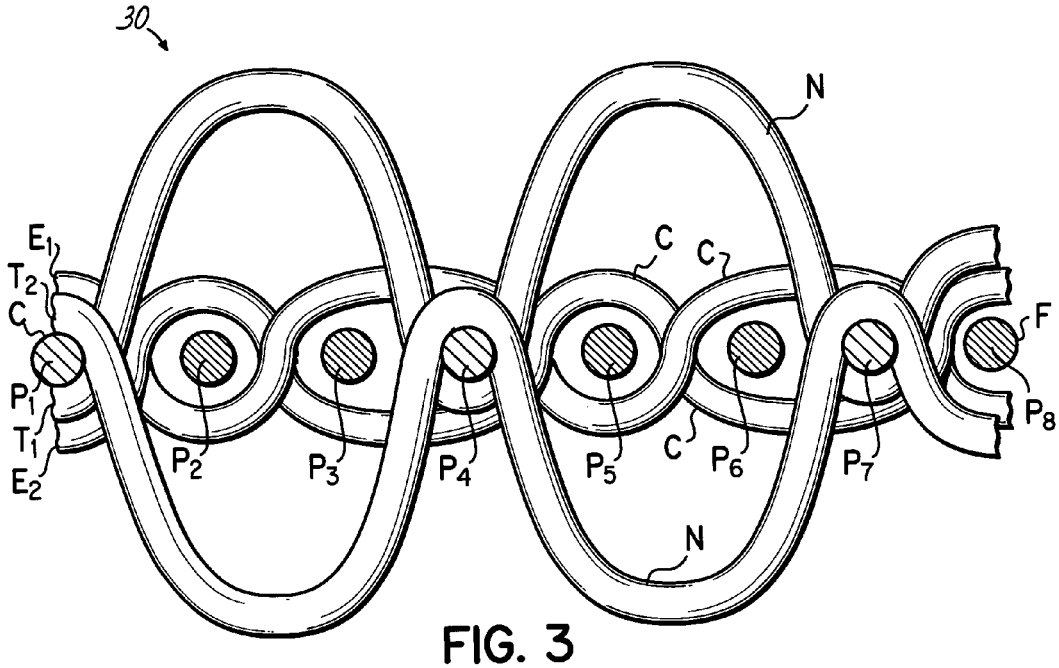
FIG. 3 is a partial, cross-sectional view, not to scale, of a portion of an alternate embodiment of a woven terry fabric in accordance with the principles of the present invention.

FIG. 3 illustrates a portion of another woven terry fabric 30 in accordance with the principles of the invention. This fabric 30 is somewhat similar to that shown in FIGS. 1 and 2, in that: it is formed using a three-pick terry-weave pattern; the warp ends $E_1$, $E_2$ are formed of spun yarn C; and the terry pile loops $T_1$, $T_2$ are formed of all-natural cotton yarn N. However, in contrast to the fabric 10, this particular fabric 30 has some picks ($P_2$, $P_3$, $P_5$, $P_6$, $P_8$) which are formed of non-moisture-transporting synthetic filament yarn F, such as polyester, and other picks ($P_1$, $P_4$, $P_7$) which are formed of spun yarn C. As with FIG. 2, FIG. 3 depicts part of a single warpwise row. Nonetheless, the warp ends and terry pile loops of the other rows of the fabric 30 may be constructed and arranged as shown in FIG. 3.

Figure 4:
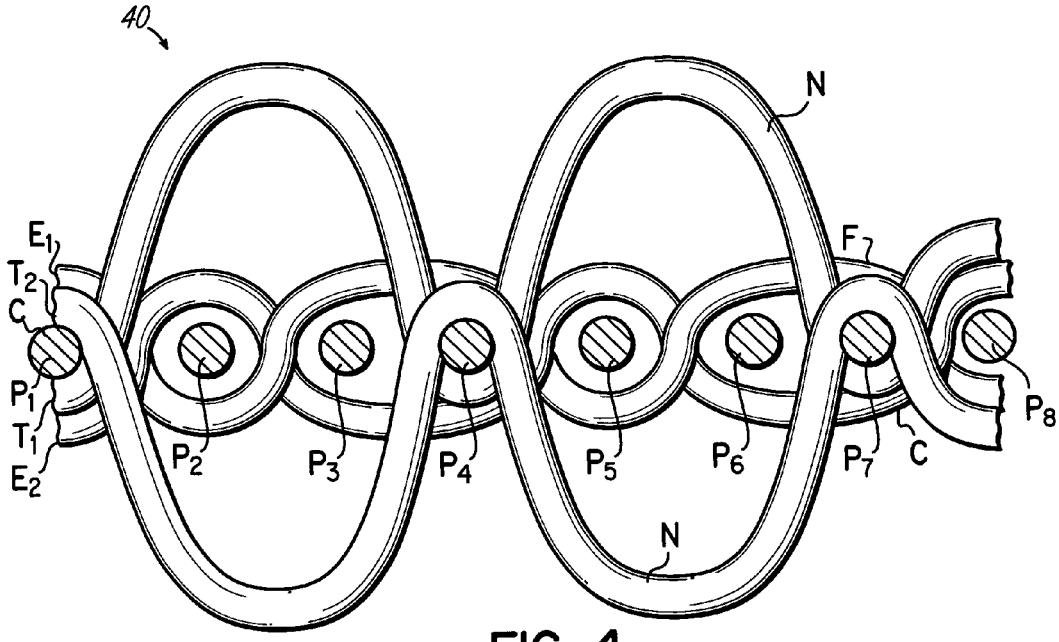
FIG. 4 is a partial, cross-sectional view, not to scale, of a portion of a further embodiment of a woven terry fabric in accordance with the principles of the present invention.

FIG. 4 illustrates a portion of yet another woven terry fabric 40 in accordance with the principles of the invention. This fabric 40 also is somewhat similar to the fabric 10 of FIGS. 1 and 2, in that: it is formed using a three-pick terry-weave pattern; the terry pile loops $T_1$, $T_2$ are formed of all-natural cotton yarn N; and the warp end $E_2$ is formed of spun yarn C. However, in contrast to the fabric 10, this fabric 40 includes a warp end $E_1$ formed of non-moisture-transporting synthetic filament yarn F, and an entire set of fill picks $P_1$, $P_2$, $P_3$, $P_4$, $P_5$, $P_6$, $P_7$, $P_8$ formed of spun yarn C. Although FIG. 4 illustrates part of a single warpwise row, the warp ends and terry pile loops of the other rows of the fabric 40 may be constructed and arranged just as shown in FIG. 4.

Figure 5:
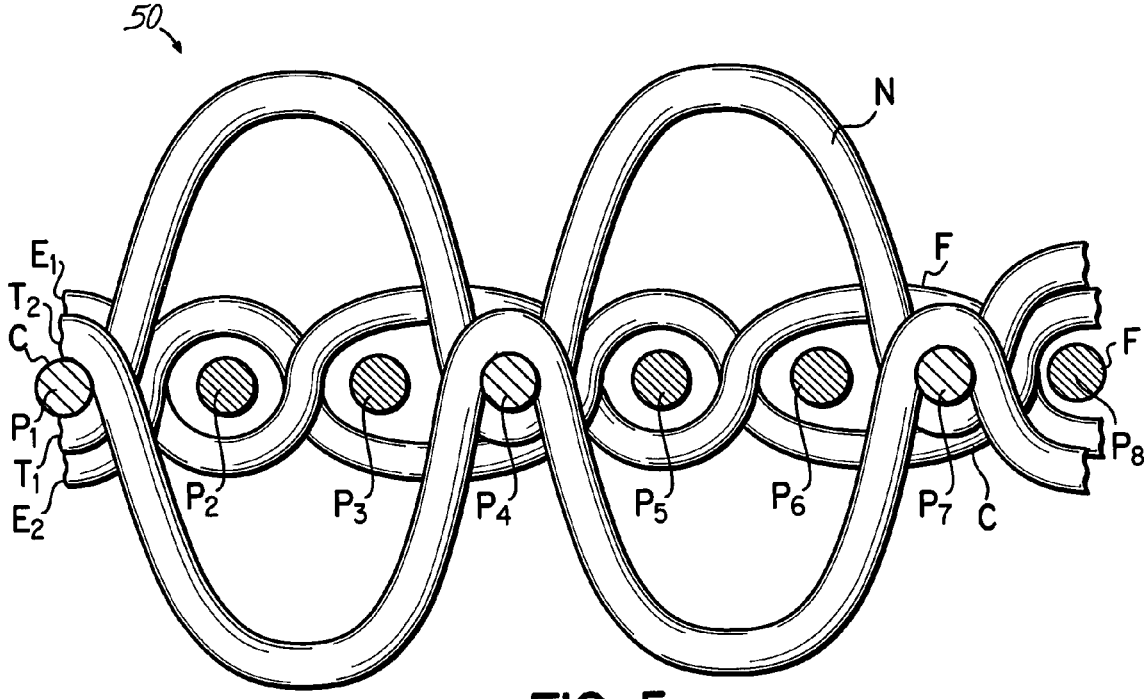
FIG. 5 is a partial, cross-sectional view, not to scale, of a portion of yet another embodiment of a woven terry fabric in accordance with the principles of the present invention.

FIG. 5 depicts a portion of an additional fabric 50 in accordance with the principles of the present invention. This fabric 50 is similar to those described above, in that it is a three-pick terry weave, and the terry pile loops $T_1$, $T_2$ are formed of all-natural cotton yarn N. However, the fabric 50 is different, in that it incorporates some of the features of the fabric 30 shown in FIG. 3, as well as some of the features of the fabric 40 shown in FIG. 4. In particular, some of the fill picks ($P_2$, $P_3$, $P_5$, $P_6$, $P_8$) are formed of non-moisture-transporting synthetic filament yarn F, such as polyester, and other fill picks ($P_1$, $P_4$, $P_7$) are formed of spun yarn C. At the same time, warp end $E_1$ is formed of non-moisture-transporting synthetic filament yarn F, such as polyester, and warp end $E_2$ is formed of spun yarn C. As with FIGS. 2-4, FIG. 5 illustrates part of a single warpwise row. Nonetheless, the warp ends and terry pile loops of the other rows of the fabric 50 may be constructed and arranged as shown in FIG. 5.

Each of the fabrics described provides several benefits and advantages. For example, each fabric provides not only a high level of absorbency and comfort, but also a simultaneously high level of durability. Moreover, this successful achievement of simultaneous absorbency, comfort, and durability is obtained using conventional, untreated, synthetic filament yarn, as opposed to either spun synthetic materials or synthetic materials which have otherwise been treated to overcome the inherent hydrophobic nature of the synthetic material. In addition, the synthetic filament yarn may be selected to impart an elastomeric quality to the fabric in the warp- and/or fill-directions. This elastomeric characteristic further enhances the comfort of the fabric by providing a tactile feature which is pleasing to fabric users. Also, the inclusion of the non-moisture-transporting synthetic filament yarns results in increased manufacturing efficiency, in the making of the fabrics. Because these synthetic filament yarns are significantly stronger than traditional spun yarns, there are fewer warp- and/or fill-breaks during the weaving operation, thereby increasing production efficiency.

In use, the woven terry fabrics may be formed into any suitable item. For example, any of the fabrics may be formed into a towel that is comfortable to the touch, absorbent, and durable.

By virtue of the foregoing, there is thus provided a woven terry fabric having advantages over prior woven terry fabrics.

While the present invention has been illustrated by the description of embodiments thereof and specific examples, and while the embodiments have been described in considerable detail, it is not intended to restrict or in any way limit the scope of the appended claims to such detail. Additional advantages and modifications will readily appear to those skilled in the art. For example, although the drawings illustrate a three-pick terry-weave pattern, any suitable pattern may be used to form the woven terry fabric. Moreover, while FIGS. 3 and 5 show a particular alternating sequence of fill picks made of synthetic filament yarn F and spun yarn C, any suitable pattern may be used. Also, as has been stated above, each of FIGS. 2-5 illustrates a single warpwise row; and, if desired, the particular yarn type or types illustrated in that row may be used for the other warpwise rows of the particular fabric. However, this is not required. For example, the woven terry fabric may have any number of warpwise rows formed of spun yarn and/or any number of warpwise rows formed of non-moisture-transporting synthetic filament yarn. Additionally, if more than one yarn type is used in the warp, any desired sequence or pattern of spun yarn and synthetic filament yarn may be used. Also, the woven terry fabric may include synthetic fibers, filaments, and/or yarns in the pile loops, with the synthetic material being polyester and/or other suitable synthetic material(s). The invention in its broader aspects is therefore not limited to the specific details, representative apparatus and methods and illustrative examples shown and described. Accordingly, departures may be made from such details without departing from the scope or spirit of applicant=s general inventive concept.

Having described the invention, what is claimed is:

1. A woven terry fabric comprising:

a plurality of warp spun yarns;

a plurality of pile loops including natural fibers of cotton; and a plurality of fill yarns, at least one of the fill yarns consisting essentially of non-moisture-transporting synthetic filament and devoid of moisture transporting fiber, the warp yarns, pile loops, and fill yarns being woven together in a three-pick terry weave.

2. The fabric of claim 1, the non-moisture-transporting synthetic filament yarn being polyester.

3. The fabric of claim 1, the fill yarns further including spun yarn.

4. The fabric of claim 3, the spun yarn being all natural fibers.

5. The fabric of claim 3, the spun yarn being all synthetic fibers.

6. The fabric of claim 3, the spun yarn including natural and synthetic fibers.

7. The fabric of claim 1, the non-moisture-transporting synthetic filament yarn being multi-filament.

8. The fabric of claim 1, the pile loops consisting essentially of natural fibers of cotton.

9. A woven terry fabric comprising:

a plurality of warp yarns, at least one of the warp yarns consisting essentially of non-moisture-transporting synthetic filament and devoid of moisture transporting fiber;

a plurality of pile loops including natural fibers of cotton; and a plurality of fill spun yarns, the warp yarns, pile loops, and fill yarns being woven together in a three-pick terry weave.

10. The fabric of claim 9, the non-moisture-transporting synthetic filament yarn being polyester.

11. The fabric of claim 9, the warp yarns further including spun yarn.

12. The fabric of claim 11, the spun yarn being all natural fibers.

13. The fabric of claim 11, the spun yarn being all synthetic fibers.

14. The fabric of claim 11, the spun yarn including natural and synthetic fibers.

15. The fabric of claim 9, the non-moisture-transporting synthetic filament yarn being multi-filament.

16. The fabric of claim 9, the pile loops consisting essentially of natural fibers of cotton.

17. A woven terry fabric comprising:

a plurality of warp yarns, at least one of the warp yarns consisting essentially of non-moisture-transporting synthetic filament yarn and devoid of moisture transporting fiber;

a plurality of pile loops including natural fibers of cotton; and a plurality of fill yarns, at least one of the fill yarns consisting essentially of non-moisture-transporting synthetic filament and devoid of moisture transporting fiber, the warp yarns, pile loops, and fill yarns being woven together in a three-pick terry weave.

18. The fabric of claim 17, the non-moisture-transporting synthetic filament yarns being polyester.

19. The fabric of claim 17, the warp yarns and the fill yarns further including spun yarn.

20. The fabric of claim 19, the spun yarn being all natural fibers.

21. The fabric of claim 19, the spun yarn being all synthetic fibers.

22. The fabric of claim 19, the spun yarn including natural and synthetic fibers.

23. The fabric of claim 17, the non-moisture-transporting synthetic filament yarns being multi-filament.

24. The fabric of claim 17, the pile loops consisting essentially of natural fibers of cotton.

25. A woven terry fabric comprising:

a plurality of warp yarns;

a plurality of pile loops including natural fibers of cotton; and a plurality of fill yarns, the warp yarns, pile loops, and fill yarns being woven together in a three-pick terry weave, wherein at least one of the plurality of warp yarns or one of the plurality of fill yarns consisting essentially of non-moisture-transporting synthetic filament and devoid of moisture transporting fiber.

26. The fabric of claim 1, the woven terry fabric defining a towel.

27. The fabric of claim 9, the woven terry fabric defining a towel.

28. The fabric of claim 17, the woven terry fabric defining a towel.

29. The fabric of claim 25, the woven terry fabric defining a towel.

* * * * *